US009663975B2

(12) United States Patent
Castro et al.

(10) Patent No.: US 9,663,975 B2
(45) Date of Patent: May 30, 2017

(54) FLEXIBLE CUT-RESISTANT LOCK

(71) Applicant: Leatherman Tool Group, Inc., Portland, OR (US)

(72) Inventors: Jeffrey B. Castro, Portland, OR (US); Richard Jeremy Hadden, White Salmon, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 14/473,763

(22) Filed: Aug. 29, 2014

(65) Prior Publication Data

US 2016/0153214 A1 Jun. 2, 2016

(51) Int. Cl.

| | |
|---|---|
| ***E05B 67/24*** | (2006.01) |
| ***E05B 67/00*** | (2006.01) |
| ***E05B 67/02*** | (2006.01) |
| ***E05B 67/28*** | (2006.01) |

(52) U.S. Cl.

CPC ..... *E05B 67/24* (2013.01); *E05B 67/003* (2013.01); *E05B 67/02* (2013.01); *E05B 67/28* (2013.01)

(58) Field of Classification Search

CPC . Y10T 70/40; Y10T 24/318; Y10T 24/44291; Y10T 70/435; Y10T 70/483; Y10T 24/2175; Y10T 24/4016; A44B 11/16; E05B 67/003; E05B 73/0005; E05B 67/02; E05B 67/24; E05B 67/28; Y10S 70/09; D07B 2201/2087; D07B 2201/2089; F16G 11/04; D03D 1/0041

USPC ..... 70/49, 30, 14, 18, 19, 456 R

See application file for complete search history.

(56) References Cited

U.S. PATENT DOCUMENTS

| | | | | |
|---|---|---|---|---|
| 1,475,256 | A * | 11/1923 | Belair | 70/18 |
| 1,660,040 | A * | 2/1928 | Lehtonen | 24/134 KB |
| 2,190,661 | A * | 2/1940 | Hauer | 70/49 |
| 2,412,056 | A * | 12/1946 | Mosch | 70/456 R |
| 3,127,918 | A * | 4/1964 | McElvain | 206/37.2 |
| 3,546,961 | A * | 12/1970 | Marton | B63C 11/26 74/502.5 |
| 3,875,771 | A * | 4/1975 | Reisner | 70/18 |
| 4,044,577 | A | 8/1977 | Horlacher | |
| 4,118,961 | A * | 10/1978 | Lee | 70/237 |
| 4,155,231 | A | 5/1979 | Zane et al. | |
| 4,543,806 | A | 10/1985 | Papandrea et al. | |
| 4,596,126 | A * | 6/1986 | Sorensen | 70/456 R |

(Continued)

FOREIGN PATENT DOCUMENTS

NL WO 2013167852 A1 * 11/2013 ..... D03D 1/0041

*Primary Examiner* — Suzanne Barrett

(74) *Attorney, Agent, or Firm* — Lane Powell, PC

(57) ABSTRACT

A portable, flexible lock is disclosed with a cut-resistant strap formed of a durable and flexible outer portion and that defines a chamber for receiving a second durable, flexible inner portion therein. The inner portion floats freely side-to-side within the chamber thereby making the inner portion more difficult to cut. In a disclosed embodiment, the outer portion is formed of woven KEVLAR and the inner portion is a stainless steel cable. The lock may include a housing assembly that holds one end of the strap while a synching device, such as a pivoting cam or the like, detachably secures a portion of the opposite end of the strap thereto when the synching device in a locked position. A lock structure holds the synching device in its locked position. One or more tools may be detachably secured to the housing assembly.

19 Claims, 6 Drawing Sheets

(56) References Cited

U.S. PATENT DOCUMENTS

| | | | | | |
|---|---|---|---|---|---|
| 4,631,770 | A * | 12/1986 | Goldberg | 7/167 | |
| 5,177,986 | A * | 1/1993 | Jensen | 70/18 | |
| 5,406,810 | A * | 4/1995 | Chen | E05B 67/003 | 70/18 |
| 5,582,046 | A * | 12/1996 | Baumwoll et al. | 70/237 | |
| 5,729,871 | A * | 3/1998 | Schulte | 24/16 R | |
| 5,791,170 | A | 8/1998 | Officer | | |
| 6,044,669 | A | 4/2000 | Levi | | |
| 6,360,405 | B1 | 3/2002 | McDaid et al. | | |
| 6,470,718 | B1 | 10/2002 | Yang | | |
| 6,510,717 | B1 | 1/2003 | Levi | | |
| 6,609,399 | B1 * | 8/2003 | Daniels, Jr. | 70/49 | |
| 6,629,440 | B1 * | 10/2003 | Meekma et al. | 70/49 | |
| 7,121,122 | B2 | 10/2006 | Levi | | |
| 7,454,932 | B2 * | 11/2008 | Hollier | E05B 73/007 | 24/170 |
| 8,132,434 | B2 * | 3/2012 | Buis | 70/14 | |
| 8,225,631 | B2 * | 7/2012 | Becker | 70/53 | |
| 8,234,757 | B2 * | 8/2012 | Lesley | 24/68 CD | |
| 8,267,290 | B2 * | 9/2012 | Schlipper | A45F 3/04 | 224/259 |
| 8,528,370 | B2 * | 9/2013 | Yu et al. | 70/14 | |
| 8,556,555 | B2 * | 10/2013 | Lesley | B60P 7/0838 | 410/100 |
| 9,334,678 | B2 * | 5/2016 | Allen | E05B 67/003 | |
| 2004/0083607 | A1 * | 5/2004 | Campbell | 29/857 | |
| 2004/0194515 | A1 * | 10/2004 | Weinraub | F41A 17/44 | 70/49 |
| 2009/0314141 | A1 | 12/2009 | Weinstein et al. | | |
| 2011/0219827 | A1 * | 9/2011 | Loughlin et al. | 70/49 | |
| 2012/0042700 | A1 | 2/2012 | Barron et al. | | |

* cited by examiner

FLEXIBLE CUT-RESISTANT LOCK

FIELD OF THE INVENTION

The present invention relates to flexible locks such as cable locks, strap locks and the like. In particular, the strap of the lock is formed of a durable and flexible outer material and defines a chamber therein for receiving a second durable, flexible inner material therein that floats freely side-to-side within the chamber thereby making it more difficult to cut through the strap.

BACKGROUND

A large variety of portable locks are available to reduce theft of objects. For example, bicycle locks can include a large metal chain or cable secured to a conventional pad lock. Unfortunately, the cable or chain of such locking systems is usually heavy and bulky, and they can be cut relatively easily with a pair of cable cutters.

An alternative bicycle lock includes a U-shaped shackle formed of cylindrical hard metal stock that locks to a cross-piece. An example of such a lock can be found in U.S. Pat. No. 4,155,231 to Zane et al. The U-shaped shackle can be mounted to a mount on a bicycle when not in use thereby facilitating its storage on the bicycle. But, the lock is heavy and not easily carried other than being stored on a bracket that travels with the object to be locked, so its use to lock objects other than bicycles is limited. Moreover, the U-shaped lock does not adjust in size for a particular locking application, such as to lock the bicycle to a tree or the like. Moreover, while the hard metal stock is more difficult to cut through than a traditional flexible cable or chain, it is still relatively easy to cut using conventional cutters.

More recently, efforts have been made to make a retractable cable lock that is compact and portable. An example of which can be found in U.S. Pat. No. 4,543,806 to Papandrea et al. A cable is coiled within a housing and retractable within the housing by a spring. The opposite end of the cable extends out of the housing and includes a locking structure that operably engages a lock mounted to the housing. A user can extend the cable from the housing to allow the lock to be wrapped around a tree or the like, but it is difficult to retract the cable back within the housing to tightly synch the cable to the item or items being locked. Moreover, in order to make the lock retractable, the cable must be thin. Such a thin cable can be easily cut with common cable cutters.

SUMMARY

Accordingly, there remains a need for a light-weight and compact lock that is cut resistant. In addition, there remains a need for a strap lock that is infinitely adjustable so that an item or items to be locked can be easily synched down tightly without relying on a spring to synch the lock. Also, there remains a need for a hand-held lock that includes tools detachably secured thereto, with those tools being related to the purpose to which the lock will be used.

The present invention includes a portable, flexible lock with a cut-resistant strap formed of a durable and flexible outer material that defines a chamber for receiving a second durable, flexible inner material therein. The inner material floats freely side-to-side within the chamber thereby making the inner material more difficult to cut. In a preferred embodiment, the outer material is woven KEVLAR and the inner material is a stainless steel cable.

In a disclosed embodiment, the lock may include a housing assembly that holds one end of the strap while a synching device, such as a pivoting cam or the like, detachably secures the opposite end of the strap thereto with the synching device in a locked position. The strap can be synched down around an item to be locked simply by pulling the opposite end through the synching device before moving the synching device to its locked position. A lock assembly holds the synching device in its locked position.

One or more tools may be detachably secured to the housing assembly. In a disclosed embodiment, a first tool plate and a second tool plate are detachably secured to the housing assembly with tools secured thereto for performing the activities related to the purpose to which the lock will used.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following detailed description will be better understood when read in conjunction with the accompanying figures.

DETAILED DESCRIPTION

A flexible lock 20 formed of a cut-resistant strap 22 operably secured to a lockable frame assembly 24 is shown in FIGS. 1-13B.

General Assembly

Figure 1:
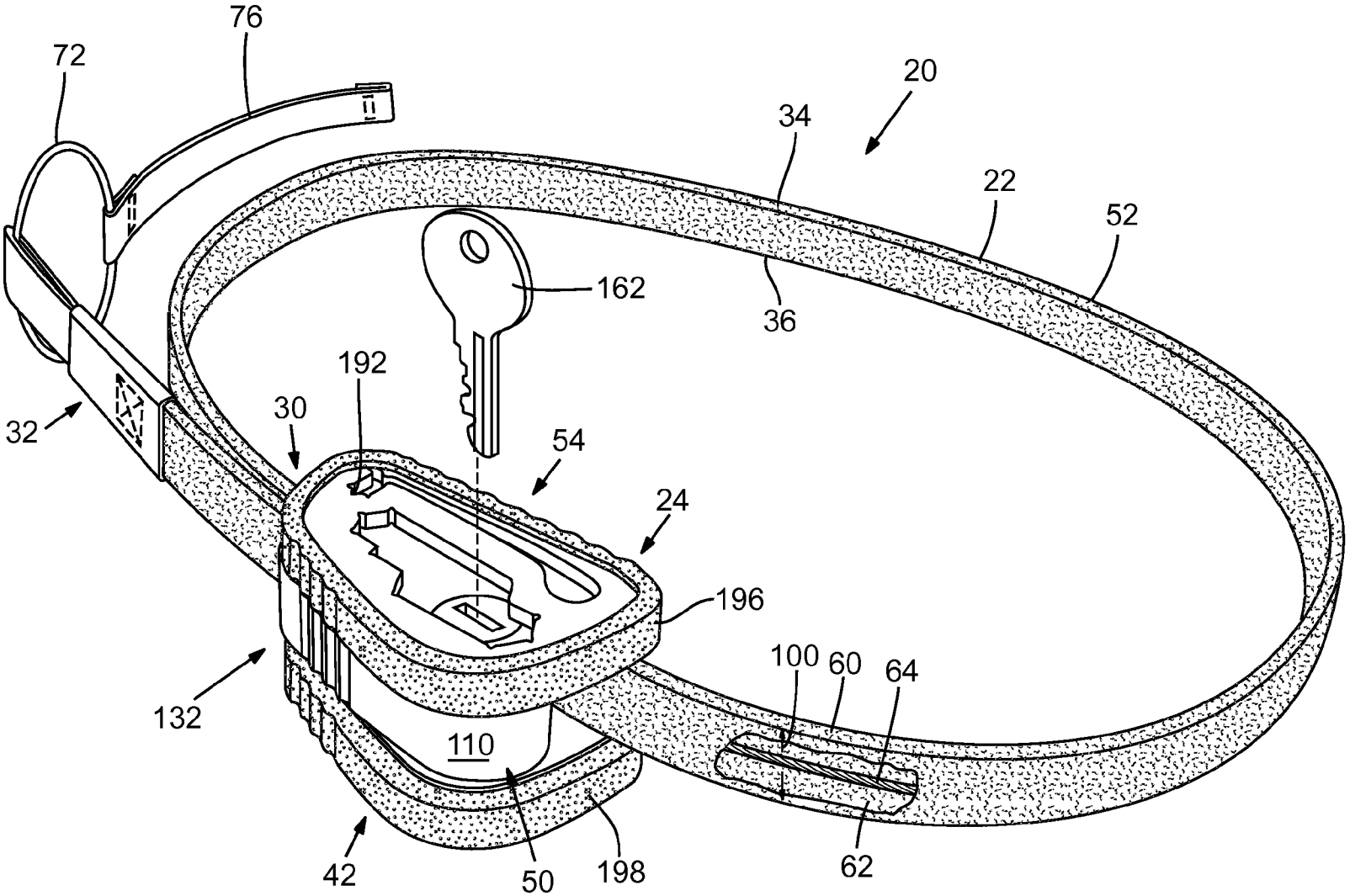
FIG. 1 is a front, right isometric view of a cut-resistant lock in accordance with an embodiment of the present invention showing a possible locked position of the lock with a portion of the strap of the lock shown in cut-away view to show internal detail.
Figure 2:
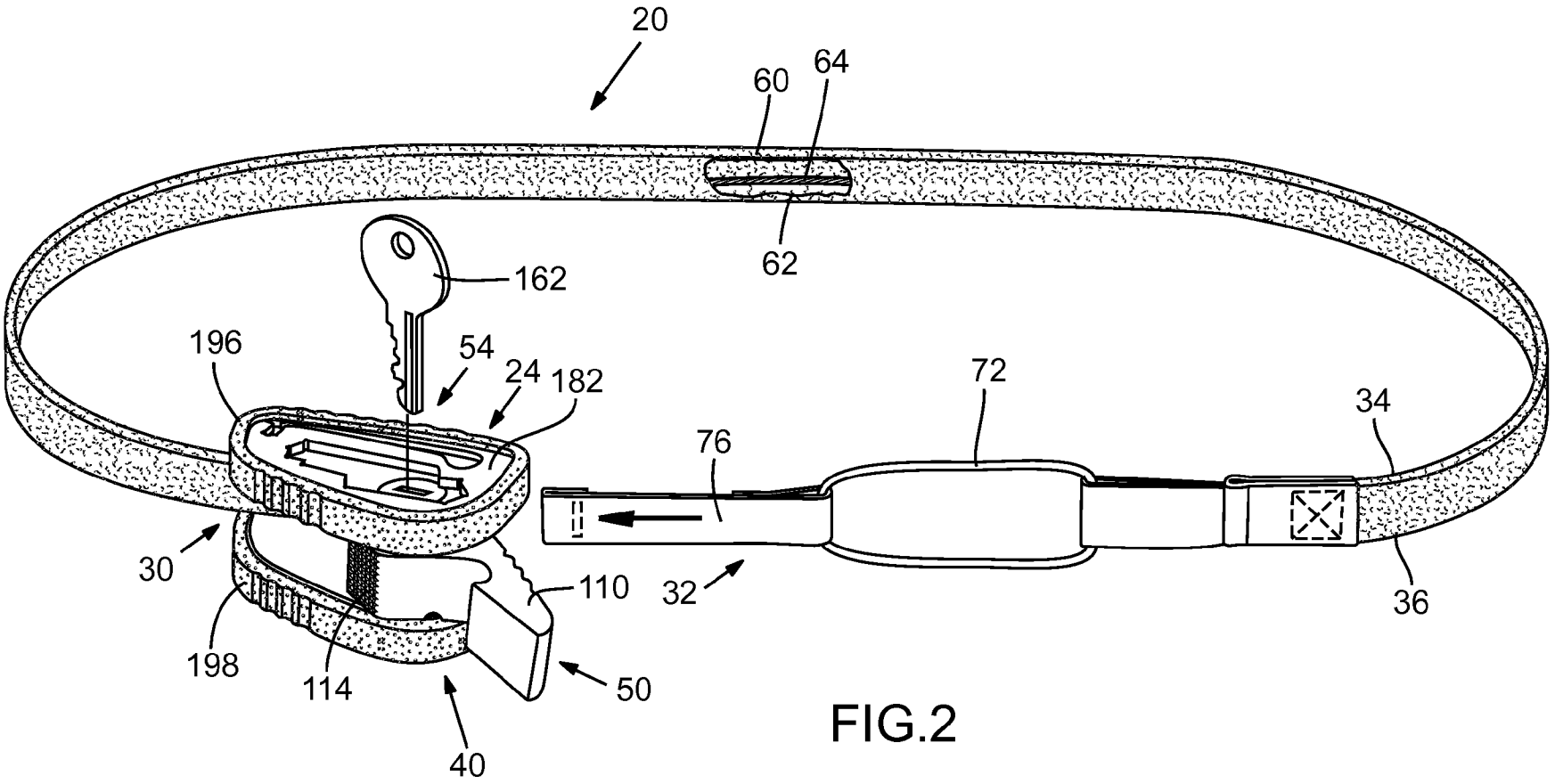
FIG. 2 is a front, right isometric view of the cut-resistant lock of FIG. 1 showing a first possible unlocked position of the lock with a portion of the strap of the lock shown in cut-away view to show internal detail.

Referring to FIGS. 1 & 2, the strap 22 has a first end 30, an opposite second end 32, a first side 34 and an opposite second side 36. The first end 30 is rigidly secured to the frame assembly 24. The opposite second end 32 is not connected to the frame assembly 24 thereby defining an unlocked position 40 of the lock 20 as shown in FIG. 2.

Figure 3:
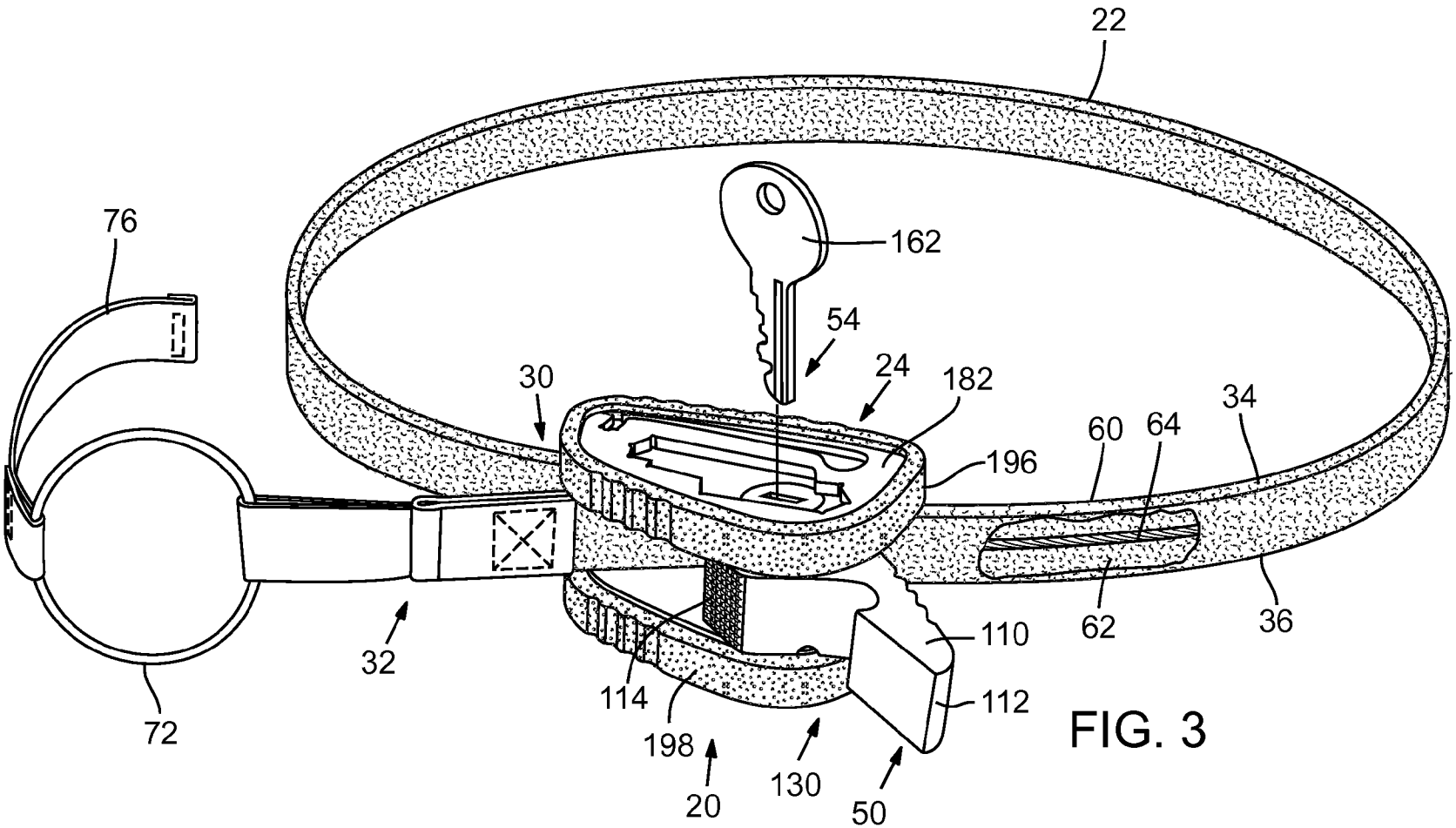
FIG. 3 is a front, right isometric view of the cut-resistant lock of FIG. 1 showing a second possible unlocked position of the lock with a portion of the strap of the lock shown in cut-away view to show internal detail.

The frame assembly 24 includes a synching device 50 that allows the second end 32 of the strap 22 to be threaded therethrough as shown in FIG. 3. The synching device 50 is then locked down against the strap 22, thereby detachably securing the strap 22 in place to define a locked position 42 of the lock 20 producing a defined lock portion 52 of the strap 22 as shown in FIG. 1. A lock assembly 54 is provided to hold the lock 20 in its locked position 42. A user can select how much of the strap 22 extends through the synching device 50 before locking down the synching device 50 thereby making the lock portion 52 of the strap infinitely adjustable as needed for a particular use.

Strap Assembly

Referring to FIGS. 7, 9A-C and the cut-away portions of FIGS. 1-3, the strap 22 is preferably formed of a durable and flexible outer portion 60 that defines a chamber 62 for receiving a durable, flexible inner portion 64 therein that floats freely side-to-side between the first side 34 and opposite second side 36 of the strap 22 within the chamber 62.

Figures 7, 8, 9A, 9B, 9C, 10, 11, 12:
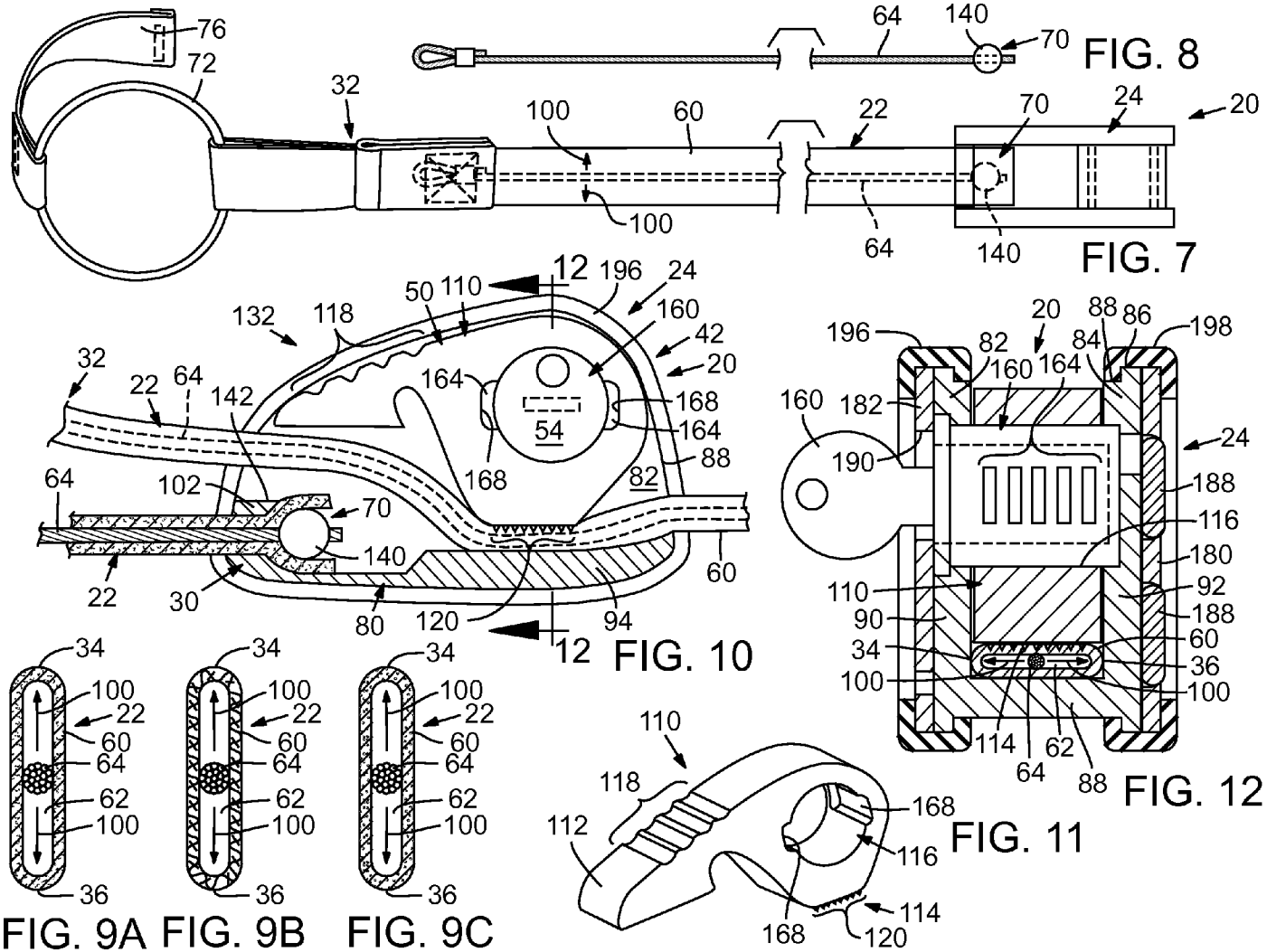
FIG. 7 is a top, elevation view of the cut-resistant lock FIG. 2 showing the strap of the lock in an unrolled extended position.
FIG. 8 is a right side, elevation view of the strap of FIG. 7, the left side, elevation view being a mirror image thereof.
FIG. 9A is a cross-sectional view taken along line 9-9 of FIG. 7 showing a first possible outer material.
FIG. 9B is a cross-sectional view taken along line 9-9 of FIG. 7 showing a second possible outer material.
FIG. 9C is a cross-sectional view taken along line 9-9 of FIG. 7 showing a third possible outer material.
FIG. 10 is an enlarged cross-sectional view of the frame assembly of FIG. 4 showing possible engagement with the strap of the lock in a possible locked position.
FIG. 11 is an enlarged, front, left isometric view of a locking cam of the frame assembly of FIG. 4.
FIG. 12 is an enlarged, cross-sectional view of the lock assembly of FIG. 10 taken along line 12-12 of FIG. 10.

Preferably, the inner portion 64 is rigidly secured to the outer portion 60 at the first end 30 and second end 32 of the strap 22 as shown in FIG. 7. However, the inner portion 64 moves freely side-to-side in the direction of arrows 100 (FIGS. 1, 7 and 9A-C) within the chamber 62 along the longitudinal length of the strap 22. This floating movement of the inner portion 64 relative to the outer portion 60 makes it more difficult for a cutting device applied to the outer portion 60 to easily grasp the inner portion 64 to cut it.

The first end 30 of the strap 22 includes a frame assembly mounting portion 70 for being operably secured to the frame assembly 24. The opposite second end 32 preferably includes a resilient, flexible ring 72, preferably formed of rubber or the like, that is used to hold the lock 20 in its storage position 74 shown in FIGS. 13A & B. More preferably, a pull tab 76 extends from the flexible ring 72 as best shown in FIG. 7. The pull tab 76 facilitates threading of the strap 22 through the synching device 50 of the frame assembly 24 as shown in FIG. 2. The pull tab 76 is preferably formed of a durable, flexible material that is easy to grasp, such as woven nylon or the like.

Preferably, the outer and inner portions (60, 64 respectively) are formed with materials that provide a durable, flexible, cut-resistant, but light weight strap 22. More preferably, the materials are selected so as to provide different cutting characteristics between the outer and inner portions (60, 64, respectively) thereby requiring a thief to have two different cutting tools to effectively cut through the strap. For example, the outer portion 60 may be formed of a high tensile strength polymer such as poly-paraphenylene terephthalamide, one brand of which is sold by the DuPont Corporation under the trademark KEVLAR, but others may be used as well. To facilitate readability, the term KEVLAR is used herein to refer to all forms of high tensile strength, cut resistant polymer.

Even more preferably, the KEVLAR is woven into a tube shape thereby defining the chamber 62 as the hollow of the tube. Weaving the KEVLAR also increases its flexibility and allows more economical strands of polymer to be used instead of more costly sheets of material without compromising the strength or cutting resistance of the material.

The inner portion 64 is preferably a cable formed of strands of flexible material such as cut-resistant metal or the like. More preferably the inner portion 64 material is formed of strands of stainless steel. The stainless steel cable may be coated with a protective polymer.

The combination of a KEVLAR outer portion 60 with a stainless steel cable inner portion 64 floating within the chamber 62 of the outer portion 60 provides particularly beneficial cut-resistant properties because a KEVLAR cutter has difficulty cutting stainless steel cable, especially when the cable is floating side-to-side within the chamber 62 defined by the KEVLAR outer portion 60. This movement of the stainless steel cable inner portion 64 within the chamber 62 makes is more difficult for conventional KEVLAR cutters to grasp the stainless steel cable.

Moreover, stainless steel cutters have difficulty cutting through woven KEVLAR. As a result, a thief would need extra time to cut through both the outer and inner portions (60, 64, respectively), or the thief would need to carry separate cutting tools each designed to cut through one of the inner and outer portions.

Other suitable materials for the outer portion 60 include woven metal strands (FIG. 9B), or a combination of materials such as strands of KEVLAR woven with stands of metal (FIG. 9C). In addition, the inner portion 64 can include metal or polymer chain link or the like. Moreover, additional portions having the same or different materials from the inner and outer portion may be sandwiched between the inner and outer portions as needed.

Also, more than one inner portion 64 may be positioned within the chamber 62 with one or more of these inner portions able to float freely side-to-side between the first side 34 and opposite second side 36 of the strap 22 within the chamber 62. For example, the inner portion 64 can include two or more cables formed of strands of flexible material like cut-resistant metal such as stainless steel cables or the like. The cable may not be secured together along their longitudinal lengths thereby allowing independent side-to-side movement between the cables within the chamber 62.

Lockable Frame Assembly

Figures 4, 5, 6A, 6B:
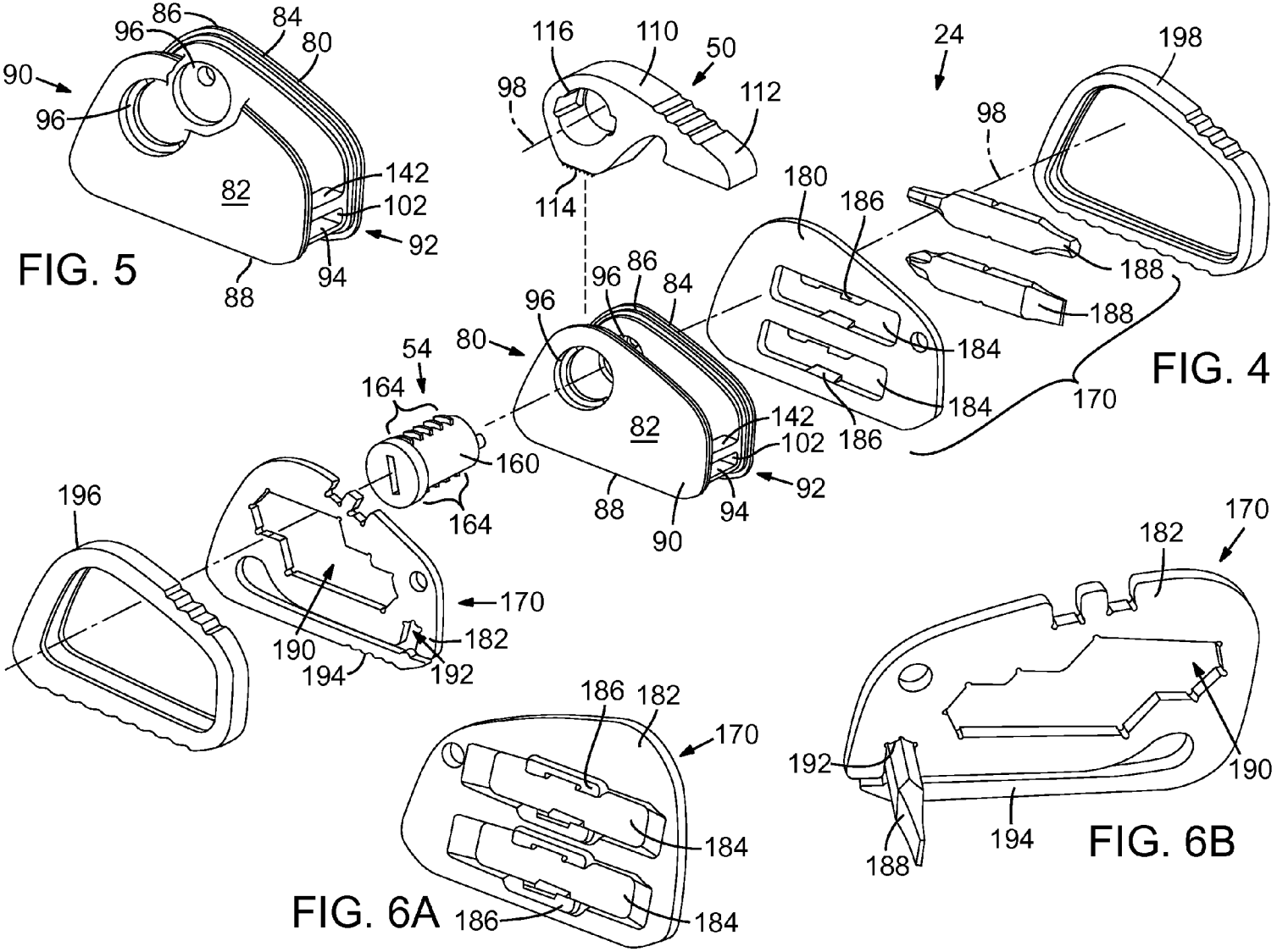
FIG. 4 is an exploded view of the frame assembly of the cut-resistant lock of FIG. 1.
FIG. 5 is a front, right isometric view of the housing of the frame assembly of FIG. 4 showing a portion of a side wall in cut-away view to reveal internal details.
FIG. 6A is a front, right isometric view of a first tool plate of the frame assembly of FIG. 4.
FIG. 6B is a front isometric view of a second tool plate of the frame assembly of FIG. 4 showing a possible tool operably secured thereto.

As best shown in FIG. 4, the frame assembly 24 has a housing 80 that defines left side wall 82, right side wall 84, upper surface 86, lower surface 88, front side 90 and rear side 92 extending from a lower base 94. Pivot holes 96 are aligned in the side walls (82, 84) for receiving a pivot 98 therethrough. A strap mounting portion 102 is provided at the rear side 92 of the housing 80 adjacent to the lower base 94 and the upper surface 86 and front side 90 of the housing 80 are open.

The synching device 50 is preferably a locking cam 110 that is pivotally secured to the pivot 98. As best shown in FIG. 11, the cam 110 has an arm portion 112, a strap engaging portion 114, and a pivot mounting portion 116. The arm portion 112 includes ridges 118 to facilitate grasping by a user. The strap engaging portion 114 includes surface abrasions 120 to facilitate compressing and holding the strap 22 wedged between the strap engaging portion 114 and the lower base 94. The pivoted position of the cam 110 relative to the frame defines a cam open position 130 shown in FIG. 3 and a cam closed or locked position 132 shown in FIG. 10. Preferably, the arm portion 112 of the cam 110 is flush with the upper surface 86 of the frame assembly 24 when the closed position 132.

Referring to FIG. 10, the frame assembly mounting portion 70 at the first end 30 of the strap 22 is operably secured to the strap mounting portion 102 of the housing 80. For example, the frame assembly mounting portion 70 can be a ball 140 that is rigidly secured to the inner portion 64 with the first portion 60 folded around the ball 140 (FIG. 8). The strap mounting portion 102 of the housing 80 can be a bracket 142 for receiving the ball 140 therein thereby holding the first end 30 of the strap 22 in place on the housing 80.

The opening between the left and right side walls 82, 84 in the front of the housing 80 allows the second end 32 to be threaded between the cam 110 and the lower base 94 and through to an opening between the walls in the rear side 92 of the housing 80 as best shown in FIG. 3. Rotating the cam 110 from its open position 130 (FIG. 3) to the closed position 132 (FIGS. 1 & 10) allows the strap engaging portion 114 of the cam 110 to engage a portion of the strap 22 against the lower base 94, thereby detachably holding the strap 22 in place.

It can be appreciated that the size of strap lock portion 52 (FIG. 1) may be adjusted simply be the user deciding where along the longitudinal length of the strap 22 to engage the cam 110 in its closed position 132 (FIGS. 1 & 10). Moreover, a user can extend the second end 32 of the strap 22 through an item to be locked, then through the housing 80, and then pull the second end 32 until the strap lock portion 52 is tightly synched around the item to be locked before moving the cam 110 to its closed position 132 (FIGS. 1 & 10).

The lock assembly 54 is provided to hold the cam 110 in its closed position 132 (FIGS. 1 & 10). For example, a conventional key activated cylinder lock 160 is shown in FIGS. 4 and 10. The key 162 extends protrusions 164 from the cylinder 166 that engage recesses 168 in the pivot mounting portion 116 of the cam 110 as best shown in FIGS. 10 and 12. The protrusions 164 remain extended when the key 162 is removed thereby preventing the cam 110 from being moved out of its closed position 132 (FIGS. 1 & 10). Alternatively, another type of lock assembly 160 may be used such as a combination lock, electronic lock or the like.

Preferably, the frame assembly 24 includes one or more tools 170 detachably secured thereto. More preferably, the tools 170 are rationally related to the purposes for which the lock with be used for. For example, in cases where the lock is to be used as a bicycle lock, the tool can include screw drivers and flat tire repair tools.

Preferably, tool plates 180, 182 are detachably secured to the side walls of the frame as best shown in FIG. 10. A first tool plate 180 has outer dimensions that conform with the outer dimensions of the right side wall 84 of the housing 80. It can include recesses 184 and attachment structures 186 for detachably receiving screw heads 188 therein as shown in FIG. 6A. A second tool plate 182 has outer dimension that conform with the outer dimensions of the left side wall 82 of the housing 80. It includes an opening 190 for allowing the key 162 to be inserted into the lock assembly 160, a mount 192 for receiving one of the screw head 188 and other tools such as a protrusion 194 (FIG. 6B) adjacent to a screw head mounting hole that serves as a spring for holding the screw head in place during use.

A first and second resilient band 196, 198 extend around the circumference of the left and right side walls (82, 84, respectively) and detachably hold the tool plates 180, 182 in place when not in use. The bands 196, 198 also serve as bumpers to protect objects from being damaged when the frame assembly 24 contacts them.

Alternatively, the tools can be configured so that they are not detachably secured to the housing 80. For example, one or both of the tool plates 180, 182 may be pivotally secured to the housing 80, thereby preventing the tool plates from being lost. In addition, the housing 80 can include mounting structures for tools, such as a recessed mount for receiving a screw head 188 therein. Accordingly, the housing can be used like a handle for driving the attached tool.

Use and Operation

Figure 13A:
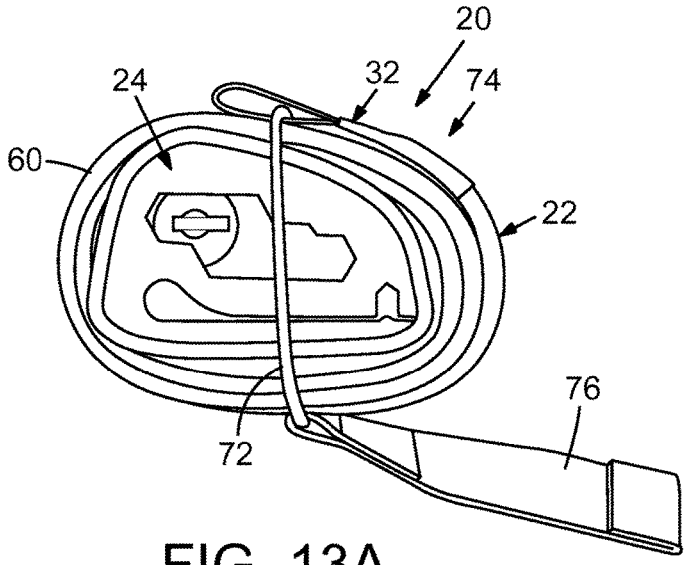
FIG. 13A is a front, plan view of the cut-resistant lock of FIG. 2 showing a possible stored position of the lock.
Figure 13B:
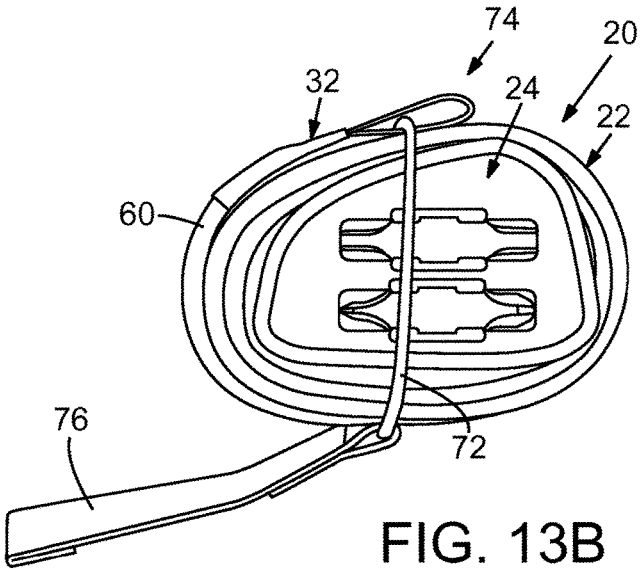
FIG. 13B is a back, plan view of the cut-resistant lock of FIG. 13A.

Having described the preferred elements forming the lock 20, its use and operation should become apparent. As shown in FIGS. 13A & 13B, the strap 22 may be coiled around the frame assembly 24 with the flexible ring 72 holding the strap 22 in place for easy transport and storage of the lock 20 when not in use. The lightweight materials and compact size allow for the lock 20 to be easily stored and carried in a backpack in an under seat carrier on a bicycle or the like.

To use the lock 20, the user disconnects the flexible ring 72 from the coiled strap 22, and positions the cam 110 in its open position 130 (FIG. 3). The user then wraps the second end 32 of the strap 22 around or through an object to be locked and then threads the pull tab 76 at the second end 32 of the strap 22 through the housing 80 between the cam 110 and the lower base 94 of the housing 80. The user then pulls the second end 32 until the object to be locked is synched tightly or a desirable amount of lock portion 54 of the strap 22 is provided, and positions the cam 110 in its closed position 132 (FIGS. 1 & 10) and removes the key 162 from the lock assembly 160.

To unlock the lock 20, the user reverses this process. By first inserting the key 162 into the lock assembly 160 and unlocking the lock assembly to release the cam 100. Then, moving the cam to its open position 130 (FIG. 3) and sliding the second end 32 of the strap 22 through the housing 80. If desired, the user can coil the strap 22 around the frame assembly 24 and secure the coil in place with the flexible ring 72.

If a user needs to use one of the tools from the tool plates 180, 182, he or she removes one or both of the resilient bands 196, 198 to release one or both of the tool plates 180, 182. If a user would like to use the screw driver, he or she removes the desired screw head 188 from the first tool plate 180 and mounts it to the mount 192 in the second tool plate 182 as shown in FIG. 6B. When finished, the user returns the tools to their proper locations in the plates 180, 182 and remounts the plates 180, 182 to the frame assembly 24 by securing the resilient bands 196, 198 in place.

The invention is disclosed above and in the accompanying figures with reference to a variety of configurations. The purpose served by the disclosure, however, is to provide an example of the various features and concepts related to the invention, not to limit the scope of the invention. For example, the outer portion 60 of the strap can be formed with multiple different cut-resistant materials, such as by integrally weaving these separate materials together. In addition, a plurality of inner portions 64 can be provided within the chamber 62. Some of these inner portions may move side-to-side while others do not. These inner portions 64 can be made of different materials from each other or the same materials, and they can have the same or different mechanical structures forming them. One skilled in the relevant art will recognize that numerous variations and modifications may be made to the configurations described above without departing from the scope of the present invention, as defined by the appended claims.

What is claimed is:

1. A lock having:

a housing;

an elongate flexible strap having a first end, an opposite second end, a first side and an opposite second side;

a flexible, cut-resistant outer portion defining a chamber therein, and a cut-resistant inner portion disposed in the chamber, the inner portion movable within the chamber between the first side and opposite second sides of the strap; and, a locking structure having an open position and a locked position operably secured to the housing and the elongate flexible strap to hold the strap in place relative to the housing to define a lock portion of the strap in the locked position and release at least one of said first and said opposite second ends of the strap in said open position.

2. The lock of claim 1, wherein said outer portion comprises a first cut-resistant material and said inner portion is formed of a second cut-resistant material.

3. The lock of claim 1, wherein said outer portion comprises a high tensile strength polymer.

4. The lock of claim 1, wherein the outer portion comprises woven high tensile strength polymer.

5. The lock of claim 4, wherein the outer portion comprises KEVLAR.

6. The lock of claim 1, wherein the inner portion comprises formed of flexible metal.

7. The lock of claim 6, wherein the flexible metal comprises stainless steel.

8. The lock of claim 7, wherein the flexible metal comprises strands of stainless steel formed into a cable.

9. The lock of claim 1, wherein the inner portion is secured to the outer portion at the first end and the opposite second end of the flexible strap.

10. The lock of claim 1, wherein the housing includes tools detachably secured thereto.

11. The lock of claim 1, wherein the locking structure includes a synching structure pivotally secured to the housing and the housing includes a base portion for wedging a portion of the strap between the synching structure and the base portion when the locking structure is in the locked position.

12. The lock of claim 11, wherein the synching structure includes a cam pivotally secured to the housing, the cam having a strap engaging portion and a handle portion.

13. The lock of claim 12, wherein the housing has an upper surface and the handle portion does not extend above the upper surface of the housing in the locked position.

14. The lock of claim 12, wherein the locking structure includes a cylinder lock operably secured between the housing and the cam at the pivot.

15. The lock of claim 1, further including a flexible ring operably secured to the second end of the strap, the flexible ring sized to extend around the housing and strap coiled around the housing, thereby holding the coiled strap around the housing for storage.

16. The portable and flexible lock comprising:

a housing having a base portion, a first side, an opposite second side, a pivot extending between the first side and second side and slot for slidably receiving a strap therethrough;

the strap having a first end, an opposite second end, a first side and an opposite second side, the strap having a flexible cut-resistant outer portion defining a chamber and a cut-resistant inner portion disposed within the chamber, the inner portion movable between the first side and second side within the chamber; the first end of the strap rigidly secured to the housing;

a cam having a strap engaging portion, a handle portion, and a pivot engaging portion pivotally secured to the housing at the pivot, the cam having an open position in which the strap engaging portion does not engage the strap when the second end of the strap is received through the slot and a locked position in which the strap engaging portion engages the strap when the second end of the strap is received through the slot so as to hold the strap within the housing; and a locking device operably secured between the housing and cam so as to lock the cam in its locked position.

17. The lock of claim 16, wherein the outer portion of the strap comprises woven KEVLAR, and the inner portion of the strap comprises a stainless steel cable.

18. The lock of claim 16, further including tools detachable secured to the housing.

19. The lock of claim 16, wherein the housing has an upper surface and the handle of the cam does not extend above the upper surface of the housing when the cam is in the locked position.

* * * * *